US008356435B2

(12) United States Patent
Chen

(10) Patent No.: US 8,356,435 B2
(45) Date of Patent: Jan. 22, 2013

(54) FLAME SIMULATING DEVICE AND ELECTRIC FIREPLACE

(76) Inventor: Li Chen, Shunde Foshan (CN)

( * ) Notice: Subject to any disclaimer, the term of this patent is extended or adjusted under 35 U.S.C. 154(b) by 297 days.

(21) Appl. No.: 12/988,496

(22) PCT Filed: Apr. 20, 2009

(86) PCT No.: PCT/CN2009/071349

§ 371 (c)(1),
(2), (4) Date: Oct. 18, 2010

(87) PCT Pub. No.: WO2009/127167

PCT Pub. Date: Oct. 22, 2009

(65) Prior Publication Data

US 2011/0030251 A1 Feb. 10, 2011

(30) Foreign Application Priority Data

Apr. 18, 2008 (CN) ..... 2008 1 0093152

(51) Int. Cl.
*G09F 19/00* (2006.01)

(52) U.S. Cl. ..... 40/428; 392/348

(58) Field of Classification Search ..... 40/582, 40/428, 583; 362/253, 234, 282–284, 322, 362/324, 33, 97.1; 359/599
See application file for complete search history.

(56) References Cited

U.S. PATENT DOCUMENTS 6,393,207 B1 * 5/2002 Martin et al. ..... 392/348
6,564,485 B1 * 5/2003 Hess ..... 40/428
6,757,487 B2 * 6/2004 Martin et al. ..... 392/348
6,944,982 B2 * 9/2005 Schroeter et al. ..... 40/428
6,968,123 B2 * 11/2005 Ravnbo-West et al. ..... 392/348
(Continued)

FOREIGN PATENT DOCUMENTS

CN 1635305 7/2005
(Continued)

OTHER PUBLICATIONS

International Search Report for international application No. PCT/CN2009/071349. Dated Jul. 30, 2009 (5 pages).

(Continued)

*Primary Examiner* — Tashiana Adams
*Assistant Examiner* — Shin Kim
(74) *Attorney, Agent, or Firm* — Hamre, Schumann, Mueller & Larson, P.C.

(57) ABSTRACT

The present invention discloses a flame simulating assembly for an electric fireplace and an electric fireplace therewith. The flame simulating assembly comprises a light source, a reflection panel, a light shelter with light openings for light penetration, and a simulating fuel-bed located within the cavity of the housing of the flame simulating assembly. The light shelter can be in form of a tube and mounted on a synchronously rotating mechanism which is in turn mounted on a bracket within the housing. The reflection panel has a reflection area in form of a flame. The light shelter forms an acute angel the reflection panel, or the axis of the light shelter is substantially parallel to or substantially perpendicular to a horizontal plane. The light shelter is below the reflection panel and fitted with it. The imaging screen is positioned above the reflection panel. The light source is positioned within the light shelter, or the light source is positioned outside the light shelter but below the light shelter. Such a structure can significantly reduce the width of a product and produce a light and dark flame effect.

19 Claims, 10 Drawing Sheets

U.S. PATENT DOCUMENTS

| | | | | |
|---|---|---|---|---|
| 7,219,456 | B1 * | 5/2007 | Wei et al. | 40/428 |
| 7,236,693 | B2 * | 6/2007 | Haugom | 392/348 |
| 7,322,136 | B2 * | 1/2008 | Chen | 40/428 |
| 7,921,585 | B2 * | 4/2011 | Wei et al. | 40/428 |
| 8,234,803 | B2 * | 8/2012 | Gallo et al. | 40/428 |
| 8,250,792 | B2 * | 8/2012 | Zhu | 40/428 |
| 2002/0168182 | A1 * | 11/2002 | Martin et al. | 392/348 |
| 2009/0220221 | A1 * | 9/2009 | Zhou | 392/348 |

FOREIGN PATENT DOCUMENTS

| | | |
|---|---|---|
| CN | 1680752 | 10/2005 |
| CN | 1752594 | 3/2006 |
| CN | 1884903 | 12/2006 |
| CN | 101097071 | 1/2008 |
| CN | 101285599 | 10/2008 |
| WO | 97/41393 | 11/1997 |

OTHER PUBLICATIONS

Written Opinion of the International Searching Authority for international application No. PCT/CN2009/071349, dated Jul. 30, 2009 (6 pages).

Examination Decision of the Patent Reexamination Board for corresponding Chinese application No. 200810093152.5, dated Dec. 7, 2010 (10 pages with English summary).

* cited by examiner

FLAME SIMULATING DEVICE AND ELECTRIC FIREPLACE

FIELD OF THE INVENTION

The present invention relates to an electric fireplace with a flame simulating assembly as well as a flame simulating assembly used for an electric fireplace.

BACKGROUND OF THE INVENTION

In the prior art there are two major kinds of flame simulating assembly used for an electric fireplace. One kind of the apparatus produces a flame vision by rotating the blades of a horizontally-installed rotational axis, which is parallel to an imaging screen. The reflection sides of the blades reflect the light from a light source and then radial moving light beams are produced. A flame shape is formed through the flame holes on a flame board and is projected onto an imaging screen and a mirror glass. Then a flame vision is produced. The other kind produces a flame vision by rotating hollow light transmitting cylinder which is horizontally installed and parallel to an imaging screen. For example, Chinese Patent Application No. 200310122956.0 disclosed an electric fireplace, in which radial moving light beams passed through the fixed holes on a light transmitting cylinder and a flame shape was formed through the flame holes on a flame board and then projected onto an imaging screen and a mirror glass.

Although the abovementioned flame simulating assembly can produce the effect of a rising "flame", the flame board and the imaging screen locates on the same side of a light source and it must maintains certain distance among them in order to produce a flame vision. Thus the width of such an apparatus is relatively large and it is difficult to manufacture a thin product. Furthermore, due to the even distribution of the light intensity through flame holes in the prior art the brightness of the entire flame almost keeps uniform and no pattern of light and dark can be obtained.

DESCRIPTION OF THE INVENTION

The object of the present invention is to provide a flame simulating assembly which can reduce the width of an electric fireplace and produce a flame of light and dark.

Another object of the present invention is to provide an electric fireplace with such a flame simulating assembly.

As one aspect the present invention provides a flame simulating assembly for an electric fireplace, comprising a light source, a reflection panel, a light shelter with numerous openings for light penetration, and a simulating fuel-bed located within the cavity of the housing of the flame simulating assembly. The light shelter can be in form of a tube and mounted on a synchronously rotating mechanism which is in turn mounted on a bracket within the housing. The reflection panel has a reflection area in form of a flame. The light shelter forms an acute angel the reflection panel, or the axis of the light shelter is substantially parallel to or substantially perpendicular to a horizontal plane. The light shelter is below the reflection panel and fitted with it. The imaging screen is positioned above the reflection panel. The light source is positioned within the light shelter, or the light source is positioned outside the light shelter but below the light shelter.

According to one embodiment of the present invention the light shelter includes an inner light shelter and an outer light shelter. The inner light shelter and the outer light shelter are in form of a tube with a polygonal section, a cylinder or a tapered tube. The synchronously rotating mechanism can comprise a synchronously motor, an active gear, an inner gear, an outer gear and a supporting shaft, in which the outer light shelter is fixedly connected to the inner gear, the inner light shelter is fixedly connected to the outer gear, and the supporting shaft is pivoted to the outer gear. The lower portion of the supporting shaft is fixedly connected to the bracket. As an specific embodiment of the flame simulating assembly for an electric fireplace in the present invention, the light source can be installed on the upper portion of the supporting shaft which locates within the space enclosed by the inner light shelter. As another specific embodiment of the flame simulating assembly for an electric fireplace in the present invention, the light source is installed within the housing and below the light shelter.

In one embodiment of the flame simulating assembly for an electric fireplace, the synchronously rotating mechanism comprises a synchronous motor, an active shaft, and a passive shaft, in which the light shelter is fixed on its both ends and fitted with the active shaft and the passive shaft. The light source is positioned below the light shelter.

In another embodiment of the flame simulating assembly for an electric fireplace, the synchronously rotating mechanism comprises a synchronously motor, an active shaft with gear, passive shafts and a passive gear. The light shelter includes an inner light shelter and an outer light shelter. The synchronous motor is fixedly connected to the active shaft with gear, and the active shaft with gear and the passive shafts are fitted with the outer light shelter which is fixed at its both ends. One of the passive shafts is fixedly connected to the passive gear and then fitted with other three of the passive shafts and the inner light shelter which is fixed at its both ends. The inner light shelter locates within the space enclosed by the outer light shelter, and the light source locates within the space enclosed by the inner light shelter.

In another embodiment of the flame simulating assembly for an electric fireplace, the synchronously rotating mechanism comprising a synchronous motor, an active shaft with gear and three passive shafts. The light shelter is fixed at its both ends and fitted with the active shaft and the passive shafts. A second synchronous motor is fixedly connected to a rotating cylinder base which is fixedly connected to a rotating cylinder with light openings. The rotating cylinder locates within the space enclosed by the light shelter. The light source is fixed within the rotating cylinder or positioned below the light shelter.

In the above flame simulating assembly for an electric fireplace, the reflection panel comprises a panel with flame openings and a glazed substrate for reflection in which they are fixed together as a superimposition, and the areas on the glazed substrate faced by the flame openings constitute the reflection areas. Alternatively, the reflection panel comprises a panel with flame openings and a glazed substrate for reflection in which they are fixed together with spacing, and the areas on the glazed substrate faced by the flame openings constitute the reflection areas. There are embossments and concaves on areas of the glazed substrate which is faced by the flame openings.

In the flame simulating assembly of the present invention, the reflection panel can comprise reflection areas in form of a flame. There are embossments and concaves on those reflection areas.

The present invention also provides a flame simulating assembly for an electric fireplace, comprising a light source, a reflection panel, an imaging screen, at least two light shelters with light openings which is positioned between the reflection panel and the imaging screen, and a simulating fuel-bed located at the front part of the cavity of the housing of the flame simulating assembly. The light shelters are in form of a disc and mounted on a synchronously rotating mechanism which is installed within the housing. The reflection panel comprises reflection areas in form of a flame on which there are embossments and concaves. The light shelters are positioned below the reflection panel. The imaging screen is positioned above the reflection panel. The light source is positioned before the light shelters. The support axis of the light shelters is substantially perpendicular to the reflection panel or forms an angle with the reflection panel in a vertical plane which is perpendicular to a horizontal plane.

In the above flame simulating assembly of the present invention, the reflection panel comprises a panel with flame openings and a glazed substrate for reflection in which they are fixed together as a superimposition. The areas on the glazed substrate which is faced by said flame openings constitute the reflection areas.

In the above flame simulating assembly of the present invention, the synchronously rotating mechanism comprises a synchronous motor and a motor support. The motor support is fixed within the housing, the light shelters are installed on a shaft of said synchronous motor, and the synchronous motor is fixedly connected to the motor support. The at least two light shelters can be fully superimposed or partially superimposed.

As another aspect the present invention also provides an electric fireplace in which the above-mentioned flame simulating assembly is installed.

In the flame simulating assembly of the present invention the light shelter can be in the shape of a tube or a disc and mounted on the synchronously rotating mechanism, the reflection panel comprises the reflection areas in form of a flame, the light shelter is positioned below the reflection panel, the imaging screen is positioned above the reflection panel, and the light source locates within or outside the light shelter. Such a structure can significantly reduce the width of a product and produce a light and dark flame effect.

The present invention will be described in detail with the following embodiments and the attached drawings. However, the present invention is not limited to these specific embodiments. Any solutions with modifications and/or replacements based on the basic spirit of the present invention are still within the protection scope defined by the following claims.

BRIEF DESCRIPTION OF THE DRAWINGS

FIG. 3-1 is a front view of a reflection panel used in a flame simulating assembly according to another embodiment of the present invention.

EMBODIMENTS OF THE INVENTION

Example 1

Figure 1:
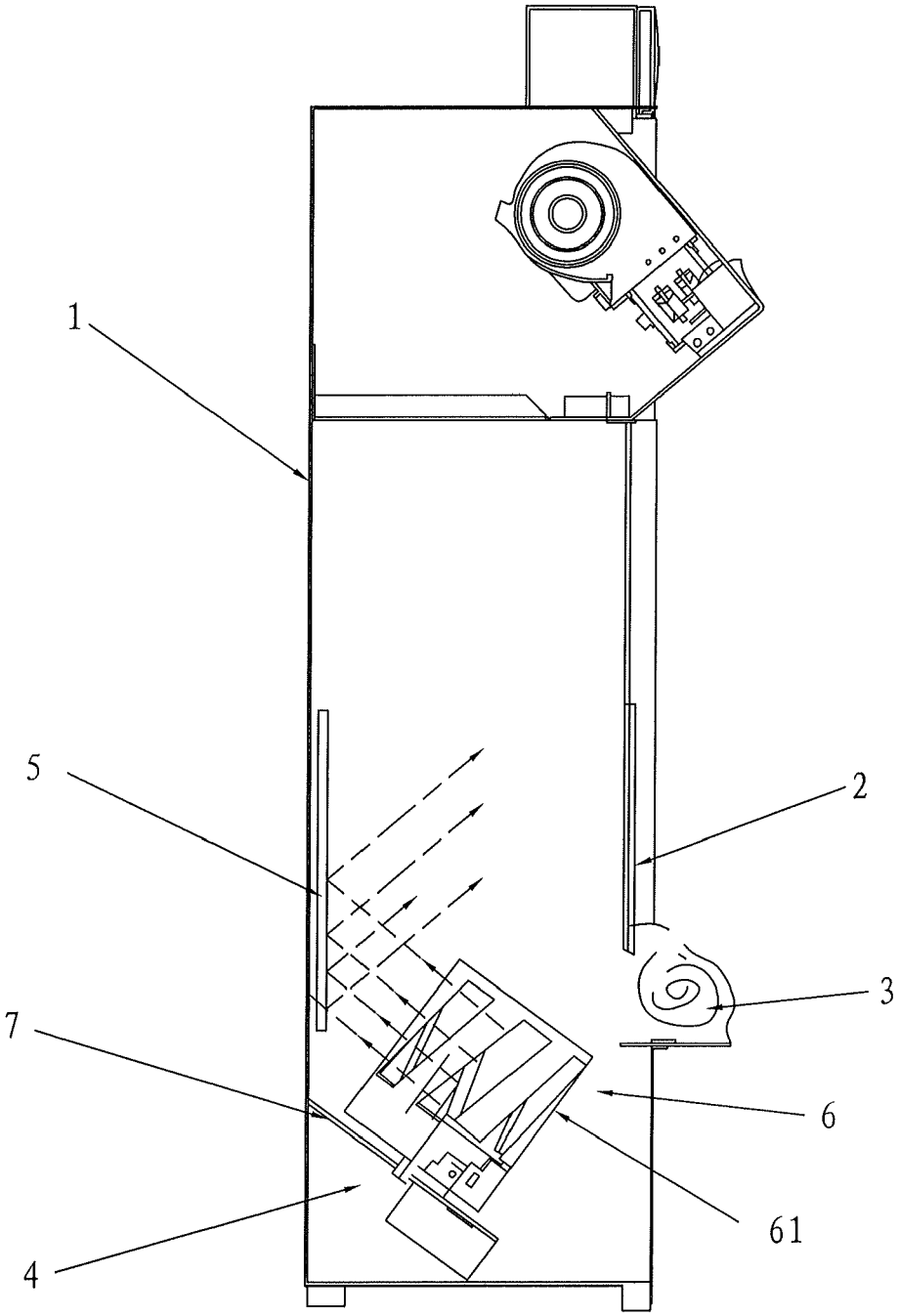
FIG. 1 is a left view of a flame simulating assembly for an electric fireplace according to one embodiment of the present invention.

Please refer to FIGS. 1-5. A flame simulating assembly for an electric fireplace shown in FIG. 1 comprises a light source 9, a reflection panel 5, an imaging screen 2, a light shelter 6 with penetration openings or light holes 8, and a simulating fuel-bed 3 located within the cavity of the housing 1 of the flame simulating assembly. The light shelter 6 with penetration openings 8 locates between the reflection panel 5 and imaging screen 2, which comprises an inner light shelter 61 and an outer lighter shelter 62. The inner light shelter 61 and the outer lighter shelter 62 can be in form of a tube. The imaging screen 2 can be positioned within the housing 1 above the simulating fuel-bed 3. The light source 9 and the light shelter 6 can be mounted on a synchronously rotating mechanism 4 which in turn is mounted on a bracket 7 within the housing 1.

Figure 3A:
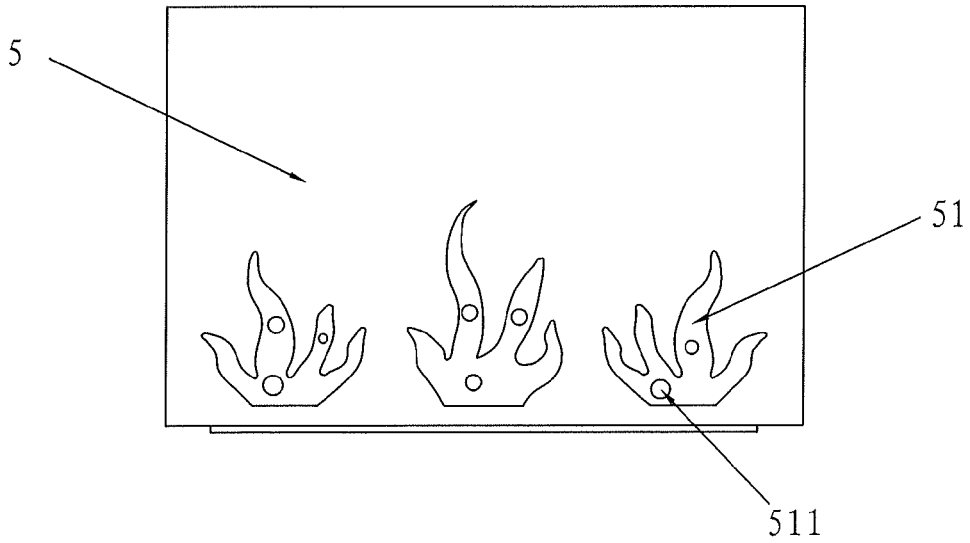
FIG. 3 is a front view of a reflection panel used in a flame simulating assembly according to one embodiment of the present invention.
Figure 3B:
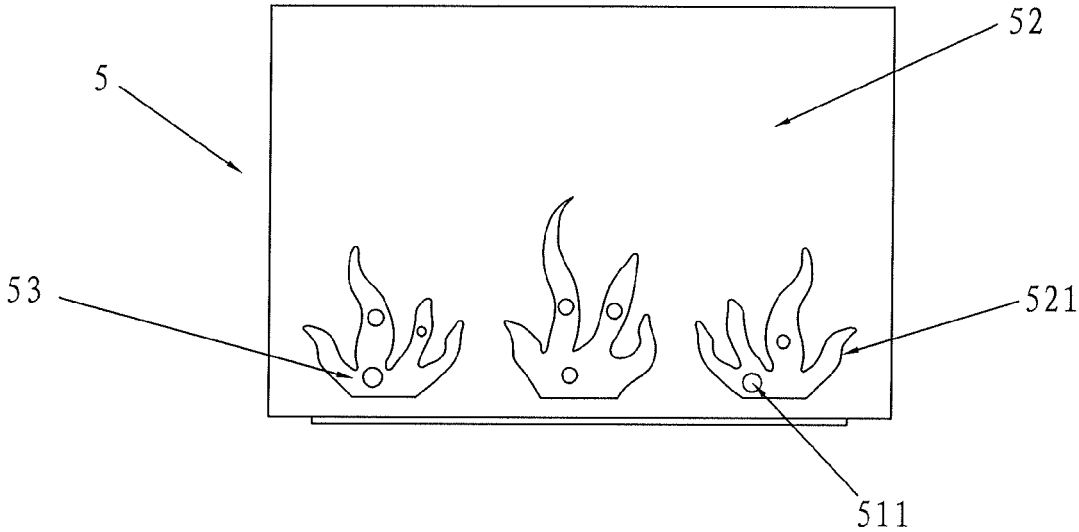

As shown in FIG. 3 the reflection panel has several reflection areas 51 in form of a flame. In a reflection area there are an embossment and a concave 511 in which both the concave 511 and the embossment can be in form of a spherical crown, a rectangle or a circle. The light shelter 6 is positioned below the reflection panel and the imaging screen 2 is positioned above the reflection screen 5. An acute angle is formed between the axis of the light shelter 6 and the reflection panel 5 so that the light permeated through the light shelter can be beamed to the reflection panel and then reflected onto the imaging screen 2 to form image. That means the axis of the light shelter 6 forms an angle with the reflection panel 5 on vertical plane. Alternatively the axis of the light shelter 6 can be parallel to horizontal plane or perpendicular to horizontal plane with being parallel to the reflection panel.

As shown in FIG. 3-1 the reflection panel 5 comprises a panel 52 with flame openings 521 and a glazed substrate 53 for reflection, which are fixed together as a superimposition. The areas on the glazed substrate 53 faced by flame openings 521 are reflection areas. The panel 52 and the glazed substrate 53 can also be fixed together with spacing.

Figure 2:
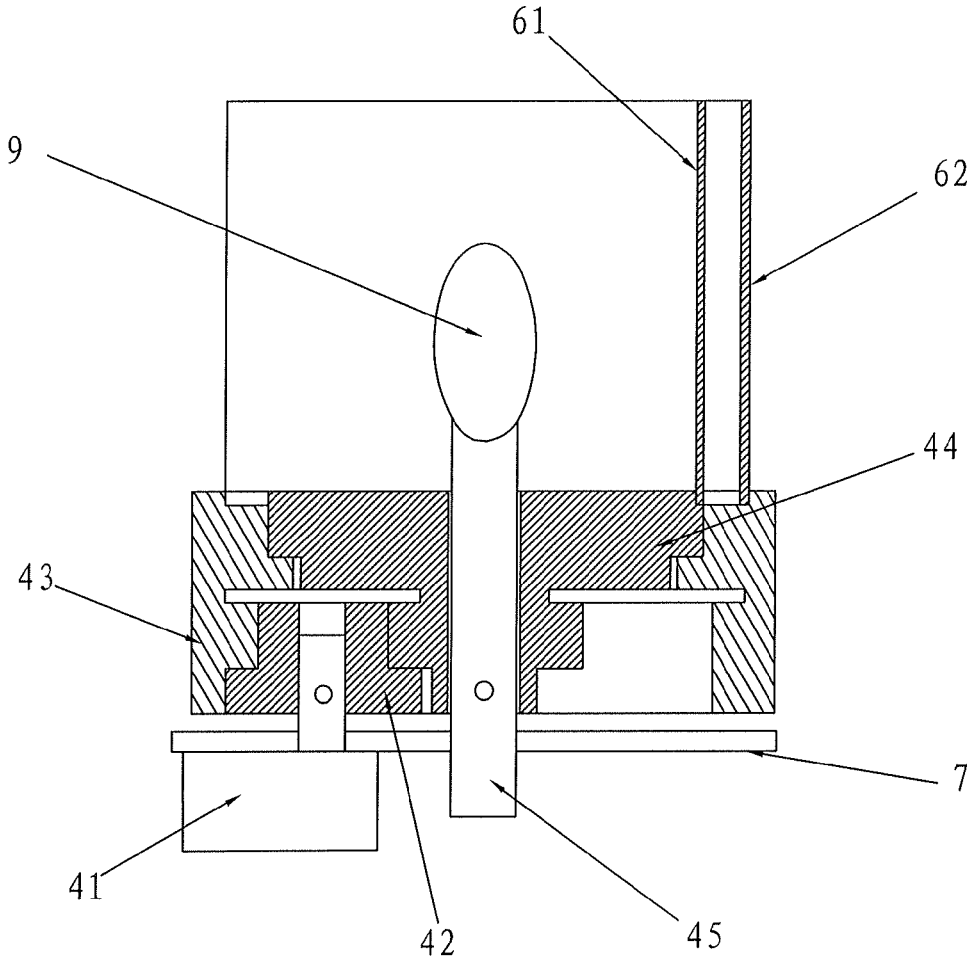
FIG. 2 shows a synchronously rotating mechanism used in a flame simulating assembly according to one embodiment of the present invention.

As shown in FIG. 2, the synchronously rotating mechanism 4 comprises a synchronous motor 41, an active gear 42, an inner gear 43, an outer gear 44, and a supporting shaft. The outer light shelter 62 is fixedly connected to the inner gear 43, and the inner light shelter 61 is fixedly connected to the outer gear 44. The supporting shaft 45 is pivoted with the outer gear 44. The shaft of the synchronous motor 41 is fixed connected to the active gear 42. The lower portion of the supporting shaft ix fixedly linked with a support 7. The light source 9 is installed on the upper portion of the supporting shaft 45 within the inner light shelter. The inner light shelter 61 and the outer light shelter 62 can be in form of a tube with a polygonal section, a cylinder or a tapered tube.

Figure 4:
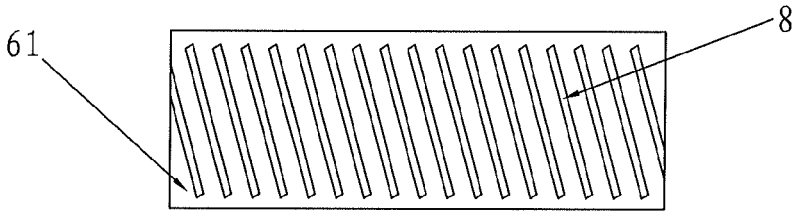
FIG. 4 is a stretch out view of an inner light shelter used in a flame simulating assembly according to one embodiment of the present invention.
Figure 5:
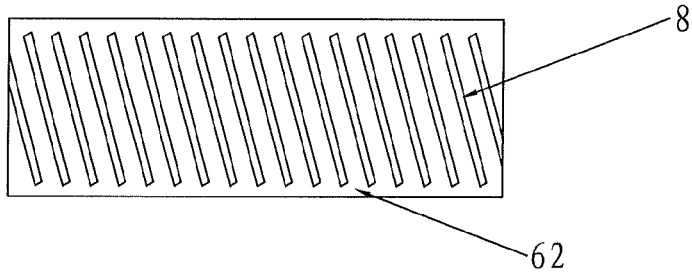
FIG. 5 is a stretch out view of an outer light shelter used in a flame simulating assembly according to one embodiment of the present invention.

As shown in FIG. 4 the light openings 8 on the inner light shelter 61 is levorotary, and as shown in FIG. 5 the light openings 8 on the outer light shelter 62 is dextrorotary. The rotary direction of the light openings 8 on the inner light shelter 61 can be same with or opposite to that on the outer light shelter 62. The projections of the light openings 8 of the inner light shelter 61 on a plane parallel to its axis are intersected with those of the outer light shelter 62.

Example 2

Figure 6:
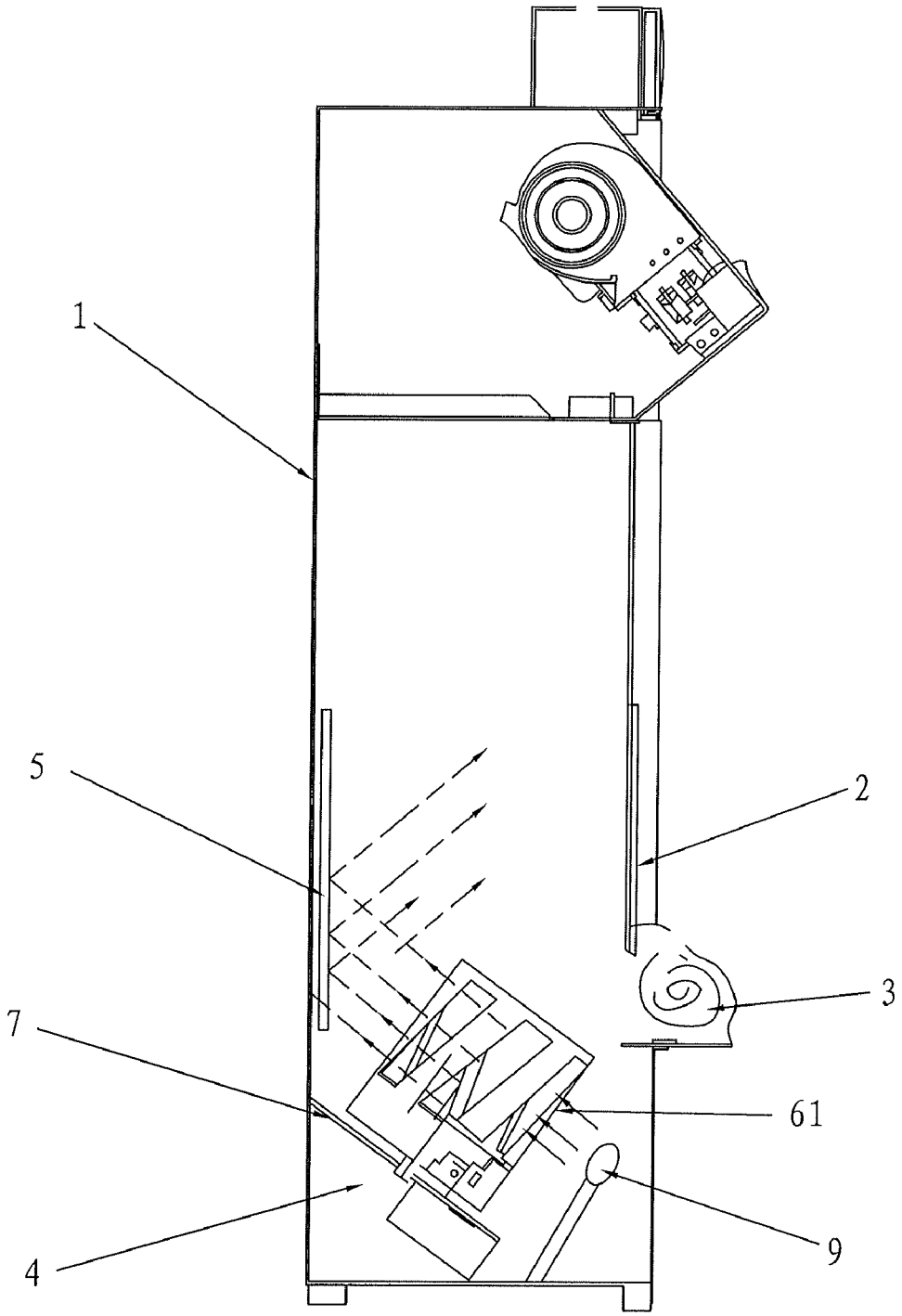
FIG. 6 is a left view of a flame simulating assembly for an electric fireplace according to another embodiment of the present invention.

FIG. 6 shows a flame simulating assembly for an electric fireplace according to another embodiment in the present invention, in which the light source is positioned between the outer light shelter 62 and the imaging screen 2 and locates below the outer light shelter 62. The light source 9 can be directly fixed within the housing 1 or can fixed within the housing 1 via a strut.

Example 3

Figure 7:
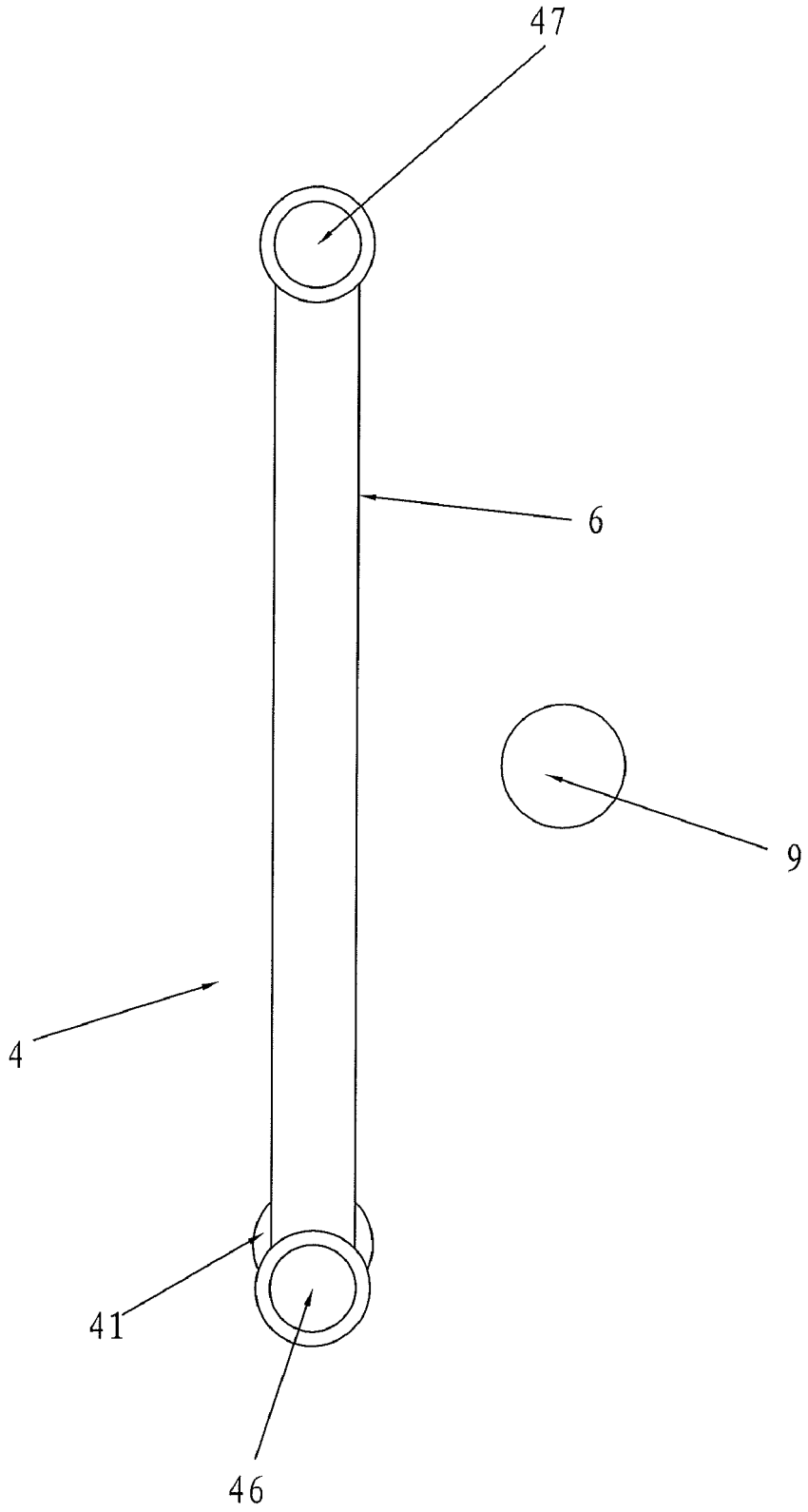
FIG. 7 shows a synchronously rotating mechanism used in a flame simulating assembly according to another embodiment of the present invention.

FIG. 7 shows another synchronously rotating mechanism 4 comprising a synchronous motor 41, an active shaft 46, and a passive shaft 47, in which both ends of the light shelter 6 are fixedly connected to the active shaft 46 and the passive shaft 47 respectively. The light shelter 6 can rotate around the active shaft 46 and the passive shaft 47, and the light source 9 locates below the light shelter 6.

Example 4

Figure 8:
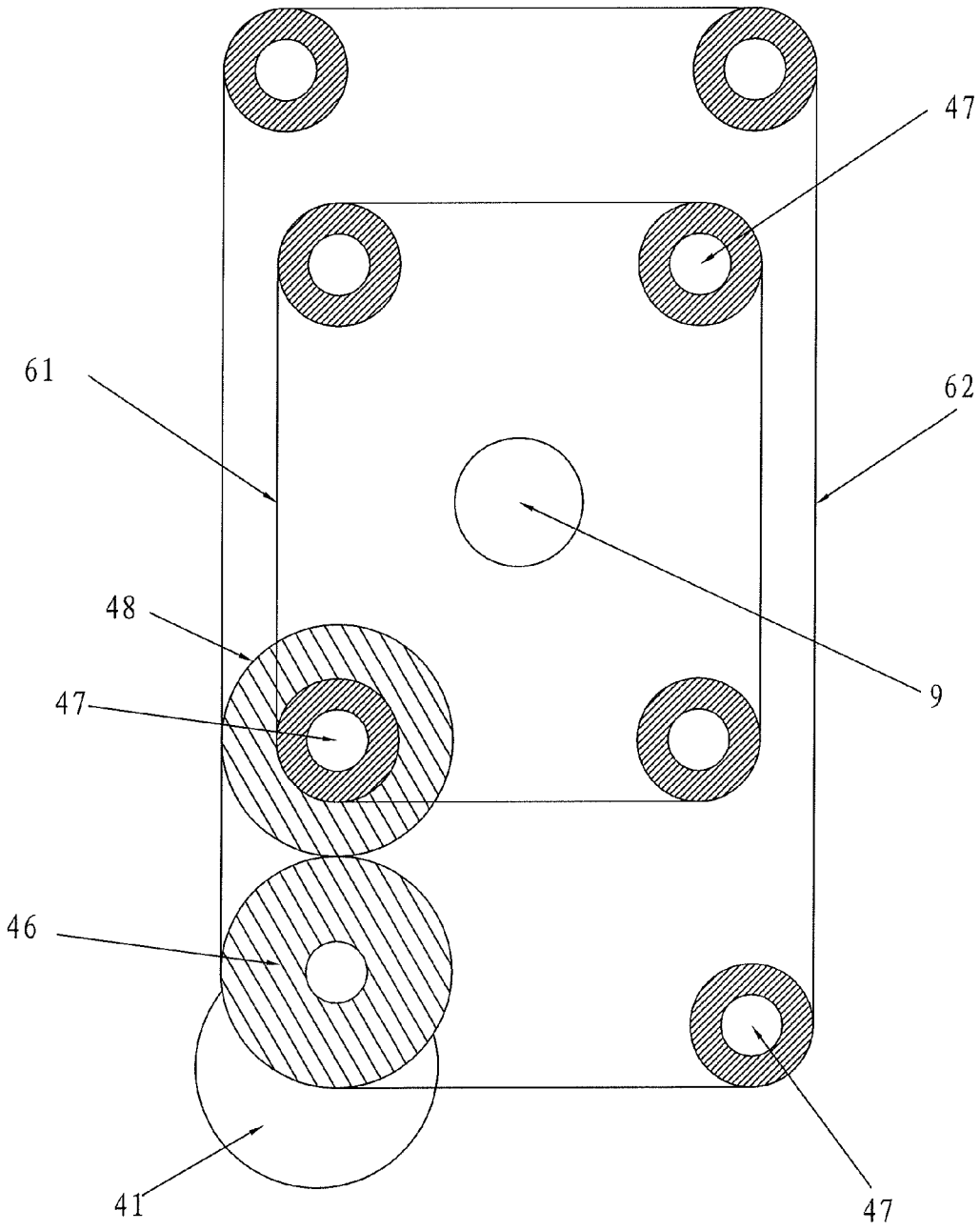
FIG. 8 shows a synchronously rotating mechanism used in a flame simulating assembly according to yet another embodiment of the present invention.

FIG. 8 shows yet another synchronously rotating mechanism 4 comprising a synchronous motor 41, an active shaft 46 with gear, passive shafts 47 and a passive gear. The light shelter 6 includes an inner light shelter 61 and an outer light shelter 62. The synchronous motor 41 is fixedly connected to the active shaft 46 with gear. The active shaft 46 and the passive shafts 47 are fitted with the outer light shelter 62 which is fixed at its both ends. The outer light shelter 62 can rotate. One of the passive shafts 47 is fixedly connected to the passive gear 48, then it is fitted with the other three passive shafts 47 and the inner light shelter 61 which is fixed at its both ends. The inner light shelter 61 locates within the space enclosed by the outer light shelter 62, and the light source 9 locates within the space enclosed by the inner light shelter 61. The active shaft 46 with gear is engaged with the passive gear 48.

Example 5

Figure 9:
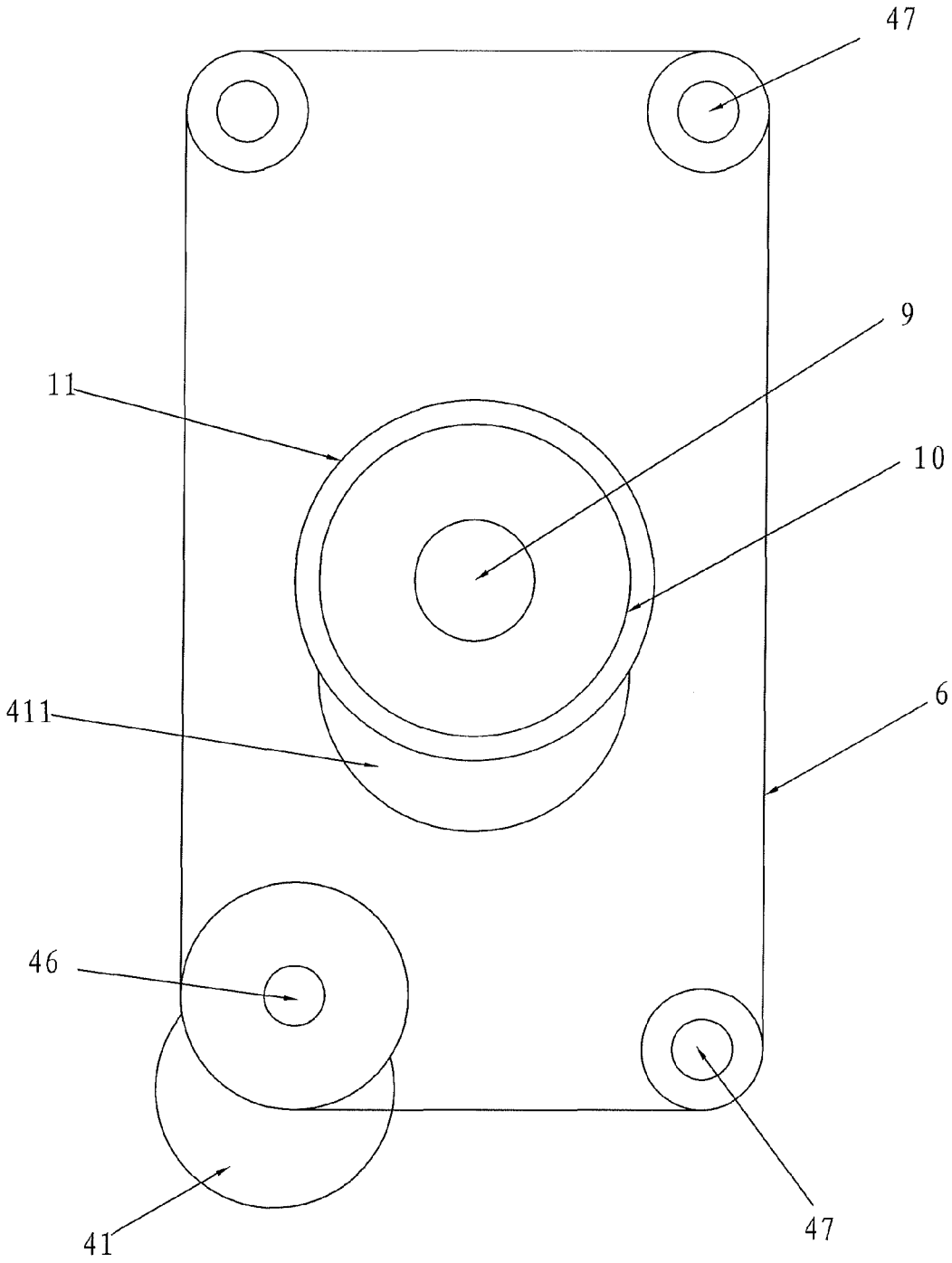
FIG. 9 shows a synchronously rotating mechanism used in a flame simulating assembly according to yet another embodiment of the present invention.

FIG. 9 shows yet another synchronously rotating mechanism 4 comprising a synchronous motor 41, an active shaft 46 with gear, and passive shafts 47. There are three passive shafts 47. The light shelter 6 is fixed at its both ends, and the light shelter 6 is fitted with the active shaft 46 and the passive shafts 47. A second synchronous motor 411 is fixedly connected to a rotating cylinder base 11 which is fixedly connected to a rotating cylinder 10 with light openings. The rotating cylinder 10 locates within the space enclosed by the light shelter 6 and the light source 9 is fixed within the rotating cylinder 10. Alternatively, the light source 9 can be positioned below the light shelter 6.

Example 6

Figure 10:
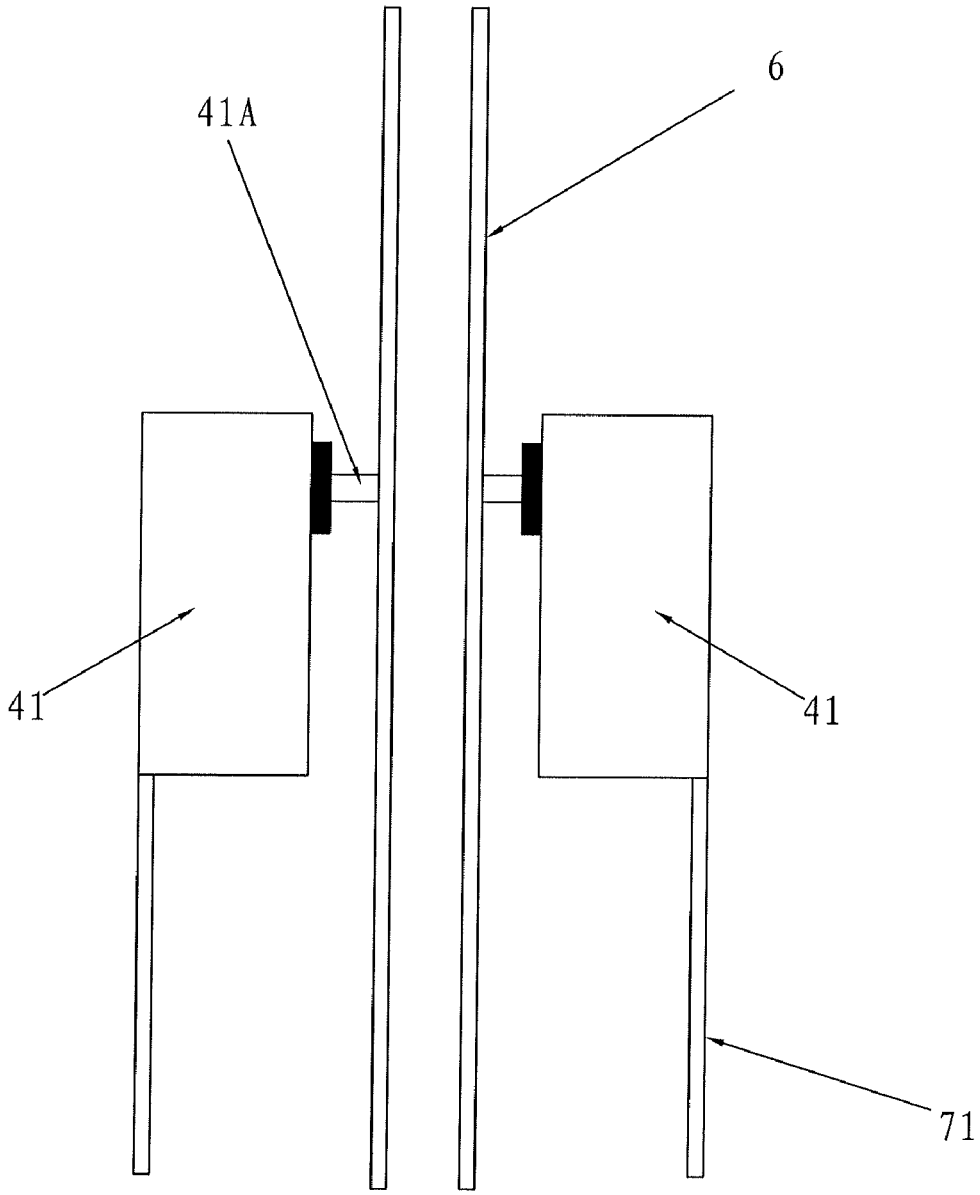
FIG. 10 shows a synchronously rotating mechanism used in a flame simulating assembly according to yet another embodiment of the present invention.
Figure 11:
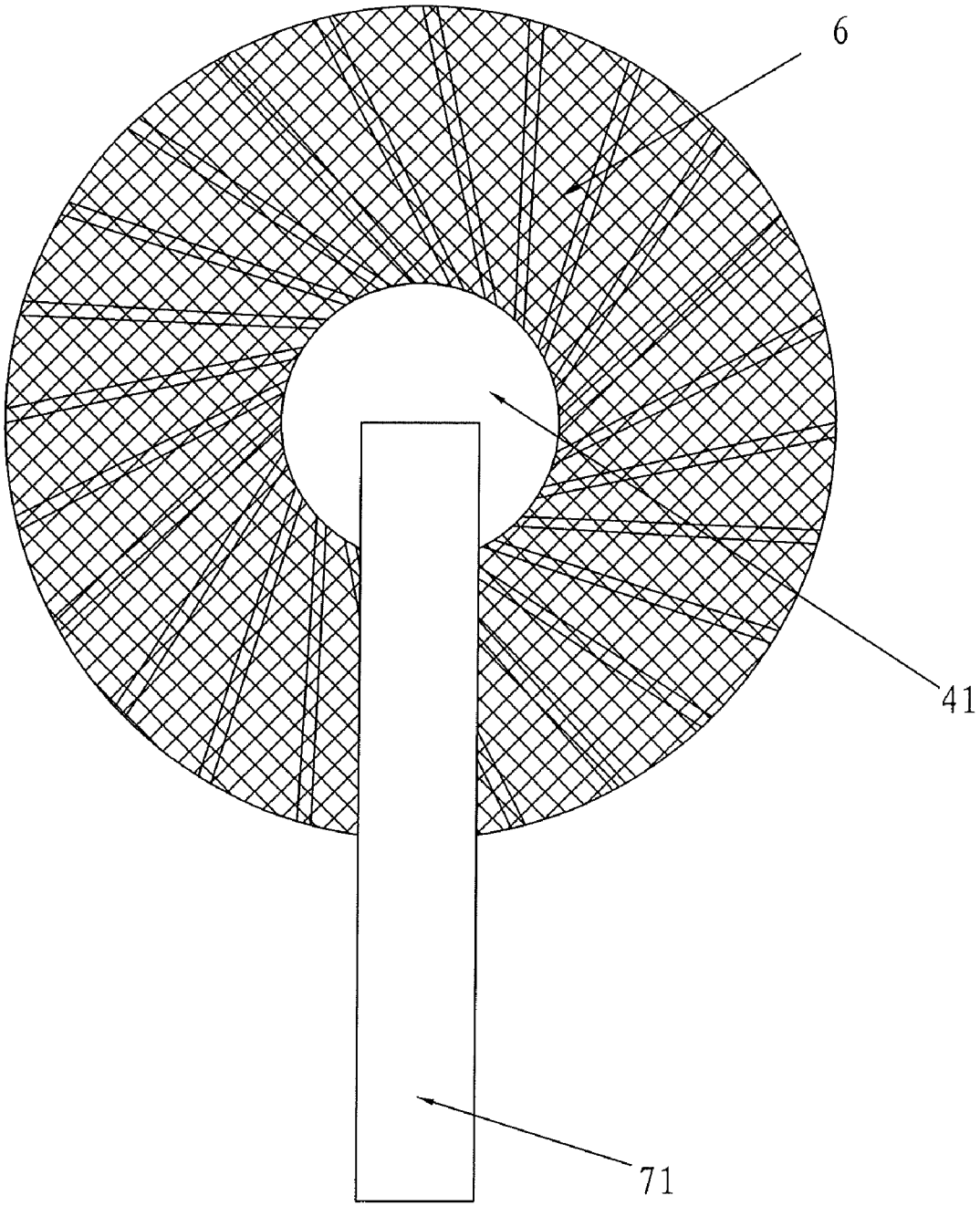
FIG. 11 shows a synchronously rotating mechanism used in a flame simulating assembly according to yet another embodiment of the present invention.

As shown in FIGS. 10-11 the light shelter 6 is form of disc. Two light shelters 6 are installed on the synchronously rotating mechanism 4 and the synchronously rotating mechanism 4 is installed within the housing 1. The light source 9 is positioned before the light shelters 6 and the support axis of the light shelters 6 is substantially perpendicular to the reflection panel 5.

Alternatively the support axis of the light shelters 6 forms an angle with the reflection panel 5 in a vertical plane, which is perpendicular to a horizontal plane.

The synchronously rotating mechanism 4 comprises a synchronous motor 41 and a motor support 71. The motor support 71 is fixed within the housing 1. The light shelters 6 are installed on a shaft 41A of the synchronous motor 41. The synchronous motor 41 is fixedly connected to the motor support 71. The two light shelters 6 can be fully superimposed or partially superimposed.

Figure 12:
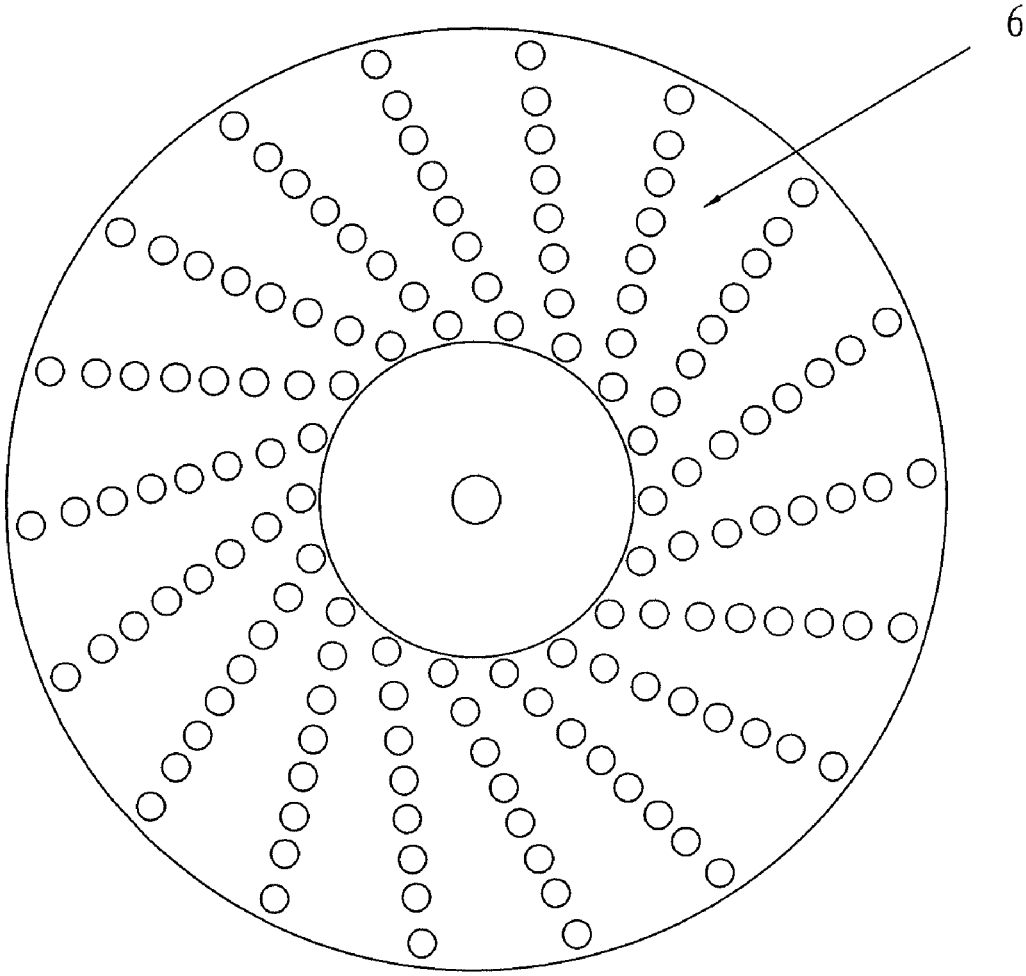
FIG. 12 is a front view of a light shelter used in a flame simulating assembly according to another embodiment of the present invention.

As shown in FIG. 12 the light shelter 6 is a disc with a plurality of light openings 8. Alternatively the light shelter can be in form of a polygon.

The invention claimed is:

1. A flame simulating assembly used for an electric fireplace, comprising a light source, a reflection panel, an imaging screen, a light shelter with light openings which is positioned between said reflection panel and said imaging screen, and a simulating fuel-bed located at the front part of the cavity of the housing of said flame simulating assembly, wherein said light shelter is in form of a tube and mounted on a synchronously rotating mechanism which is mounted on a bracket within the housing, the axis of said light shelter forms an acute angel with said reflection panel and said light shelter is fitted with said reflection panel, said light shelter is positioned below said reflection panel and said imaging screen is positioned above said reflection panel, said light source is positioned within said light shelter or said light source is positioned outside said light shelter but below said light shelter, and said reflection panel comprises reflection areas in form of a flame on which there are embossments and concaves.

2. The flame simulating assembly according to claim 1, wherein said light shelter includes an inner light shelter and an outer light shelter, said inner light shelter and said outer light shelter are in form of a tube with a polygonal section, a cylinder or a tapered tube, said synchronously rotating mechanism comprises a synchronously motor, an active gear, an inner gear, an outer gear and a supporting shaft, said outer light shelter is fixedly connected to said inner gear and said inner light shelter is fixedly connected to said outer gear, said supporting shaft is pivoted to said outer gear, the lower portion of said supporting shaft is fixedly connected to said bracket, and said light source is installed on the upper portion of said supporting shaft which locates within the space enclosed by said inner light shelter.

3. The flame simulating assembly according to claim 1, wherein said light shelter includes an inner light shelter and an outer light shelter, said inner light shelter and said outer light shelter are in form of a tube with a polygonal section, a cylinder or a tapered tube, said synchronously rotating mechanism comprises a synchronously motor, an active gear, an inner gear, an outer gear and a supporting shaft, said outer light shelter is fixedly connected to said inner gear and said inner light shelter is fixedly connected to said outer gear, said supporting shaft is pivoted to said outer gear, the lower portion of said supporting shaft is fixedly connected to said bracket, and said light source is installed within said housing and below said light shelter.

4. The flame simulating assembly according to claim 1, wherein said synchronously rotating mechanism comprises a synchronous motor, an active shaft, and a passive shaft, said light shelter is fixed on its both ends and fitted with said active shaft and said passive shaft, and said light source is positioned below said light shelter.

5. The flame simulating assembly according to claim 1, wherein said synchronously rotating mechanism comprises a synchronously motor, an active shaft with gear, passive shafts and a passive gear, said light shelter includes an inner light shelter and an outer light shelter, said synchronous motor is fixedly connected to said active shaft with gear, said active shaft with gear and said passive shafts are fitted with said outer light shelter which is fixed at its both ends, one of said passive shafts is fixedly connected to said passive gear and then fitted with other three of said passive shafts and said inner light shelter which is fixed at its both ends, said inner light shelter locates within the space enclosed by said outer light shelter, and said light source locates within the space enclosed by said inner light shelter.

6. The flame simulating assembly according to claim 1, wherein said synchronously rotating mechanism comprising a synchronous motor, an active shaft with gear and three passive shafts, said light shelter is fixed at its both ends and fitted with said active shaft and said passive shafts, a second synchronous motor is fixedly connected to a rotating cylinder base which is fixedly connected to a rotating cylinder with light openings, said rotating cylinder locates within the space enclosed by said light shelter, and said light source is fixed within said rotating cylinder or positioned below said light shelter.

7. The flame simulating assembly according to claim 1, wherein said reflection panel comprises a panel with flame openings and a glazed substrate for reflection in which they are fixed together as a superimposition, and the areas on said glazed substrate which is faced by said flame openings constitute said reflection areas.

8. The flame simulating assembly according to claim 1, wherein said reflection panel comprises a panel with flame openings and a glazed substrate for reflection in which they are fixed together with spacing, and the areas on said glazed substrate which is faced by said flame openings constitute said reflection areas.

9. A flame simulating assembly used for an electric fireplace, comprising a light source, a reflection panel, an imaging screen, at least two light shelters with light openings which is positioned between said reflection panel and said imaging screen, and a simulating fuel-bed located at the front part of the cavity of the housing of said flame simulating assembly, wherein said light shelters are in form of a disc and are mounted on a synchronously rotating mechanism which is installed within the housing, said reflection panel comprises reflection areas in form of a flame on which there are embossments and concaves, said light shelters are positioned below said reflection panel, said imaging screen is positioned above said reflection panel, said light source is positioned before said light shelters, and the support axis of said light shelters is substantially perpendicular to said reflection panel or forms an angle with said reflection panel in a vertical plane.

10. The flame simulating assembly according to claim 9, wherein said reflection panel comprises a panel with flame openings and a glazed substrate for reflection in which they are fixed together as a superimposition, and the areas on said glazed substrate which is faced by said flame openings constitute said reflection areas.

11. The flame simulating assembly according to claim 9, wherein said synchronously rotating mechanism comprises a synchronous motor and a motor support, said motor support is fixed within the housing, said light shelters are installed on a shaft of said synchronous motor, said synchronous motor is fixedly connected to said motor support, and said at least two light shelters are fully superimposed or partially superimposed.

12. An electric fireplace comprising a flame simulating assembly, said flame simulating assembly comprising a light source, a reflection panel, an imaging screen, a light shelter with light openings which is positioned between said reflection panel and said imaging screen, and a simulating fuel-bed located at the front part of the cavity of the housing of said flame simulating assembly, wherein said light shelter is in form of a tube and mounted on a synchronously rotating mechanism which is mounted on a bracket within the housing, the axis of said light shelter forms an acute angel with said reflection panel and said light shelter is fitted with said reflection panel, said light shelter is positioned below said reflection panel and said imaging screen is positioned above said reflection panel, said light source is positioned within said light shelter or said light source is positioned outside said light shelter but below said light shelter, and said reflection panel comprises reflection areas in form of a flame on which there are embossments and concaves.

13. The electric fireplace according to claim 12, wherein said light shelter includes an inner light shelter and an outer light shelter, said inner light shelter and said outer light shelter are in form of a tube with a polygonal section, a cylinder or a tapered tube, said synchronously rotating mechanism comprises a synchronously motor, an active gear, an inner gear, an outer gear and a supporting shaft, said outer light shelter is fixedly connected to said inner gear and said inner light shelter is fixedly connected to said outer gear, said supporting shaft is pivoted to said outer gear, the lower portion of said supporting shaft is fixedly connected to said bracket, and said light source is installed on the upper portion of said supporting shaft which locates within the space enclosed by said inner light shelter.

14. The electric fireplace according to claim 12, wherein said light shelter includes an inner light shelter and an outer light shelter, said inner light shelter and said outer light shelter are in form of a tube with a polygonal section, a cylinder or a tapered tube, said synchronously rotating mechanism comprises a synchronously motor, an active gear, an inner gear, an outer gear and a supporting shaft, said outer light shelter is fixedly connected to said inner gear and said inner light shelter is fixedly connected to said outer gear, said supporting shaft is pivoted to said outer gear, the lower portion of said supporting shaft is fixedly connected to said bracket, and said light source is installed within said housing and below said light shelter.

15. The electric fireplace according to claim 12, wherein said synchronously rotating mechanism comprises a synchronous motor, an active shaft, and a passive shaft, said light shelter is fixed on its both ends and fitted with said active shaft and said passive shaft, and said light source is positioned below said light shelter.

16. The electric fireplace according to claim 12, wherein said synchronously rotating mechanism comprises a synchronously motor, an active shaft with gear, passive shafts and a passive gear, said light shelter includes an inner light shelter and an outer light shelter, said synchronous motor is fixedly connected to said active shaft with gear, said active shaft with gear and said passive shafts are fitted with said outer light shelter which is fixed at its both ends, one of said passive shafts is fixedly connected to said passive gear and then fitted with other three of said passive shafts and said inner light shelter which is fixed at its both ends, said inner light shelter locates within the space enclosed by said outer light shelter, and said light source locates within the space enclosed by said inner light shelter.

17. The electric fireplace according to claim 12, wherein said synchronously rotating mechanism comprising a synchronous motor, an active shaft with gear and three passive shafts, said light shelter is fixed at its both ends and fitted with said active shaft and said passive shafts, a second synchronous motor is fixedly connected to a rotating cylinder base which is fixedly connected to a rotating cylinder with light openings, said rotating cylinder locates within the space enclosed by said light shelter, and said light source is fixed within said rotating cylinder or positioned below said light shelter.

18. The electric fireplace according to claim 12, wherein said reflection panel comprises a panel with flame openings and a glazed substrate for reflection in which they are fixed together as a superimposition, and the areas on said glazed substrate which is faced by said flame openings constitute said reflection areas.

19. The electric fireplace according to claim 12, wherein said reflection panel comprises a panel with flame openings and a glazed substrate for reflection in which they are fixed together with spacing, and the areas on said glazed substrate which is faced by said flame openings constitute said reflection areas.

* * * * *